US008040362B2

(12) United States Patent
Hu et al.

(10) Patent No.: US 8,040,362 B2
(45) Date of Patent: Oct. 18, 2011

(54) DRIVING DEVICE AND RELATED OUTPUT ENABLE SIGNAL TRANSFORMATION DEVICE IN AN LCD DEVICE

(75) Inventors: Yu-Tsung Hu, Changhua County (TW); Ching-Wen Kong, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 819 days.

(21) Appl. No.: 12/125,051

(22) Filed: May 21, 2008

(65) Prior Publication Data

US 2009/0225104 A1 Sep. 10, 2009

(30) Foreign Application Priority Data

Mar. 6, 2008 (TW) ..... 97107869 A

(51) Int. Cl.
*G09G 5/10* (2006.01)

(52) U.S. Cl. ..... 345/690; 345/86; 345/87; 345/88; 345/89; 345/90; 345/91; 345/92; 345/93; 345/94; 345/95; 345/96; 345/97; 345/98; 345/99; 345/100; 345/101; 345/102; 345/103; 345/104; 345/204; 345/208

(58) Field of Classification Search ..... 345/86–104, 345/204, 208
See application file for complete search history.

(56) References Cited

U.S. PATENT DOCUMENTS

2007/0018919 A1* 1/2007 Zavracky et al. ..... 345/87
* cited by examiner

*Primary Examiner* — Richard Hjerpe
*Assistant Examiner* — Jeffrey Steinberg
(74) *Attorney, Agent, or Firm* — Winston Hsu; Scott Margo

(57) ABSTRACT

An output enable signal transformation device for a gate driver in an LCD device includes a reception terminal coupled to a timing generator of the LCD device for receiving an enable synchronization signal, an enable clock signal and a plurality of enable control signals generated by the timing generator, a shift register module coupled to the reception terminal for shifting the enable synchronization signal according to the enable clock signal, a multiplexer module coupled to the shift register module and the timing generator for generating a plurality of output enable signals according to the enable synchronization signal and the plurality of enable control signals, and an output terminal coupled to the multiplexer module and a logic circuit of the gate driver for outputting the plurality of output enable signals to the logic circuit.

15 Claims, 10 Drawing Sheets

DRIVING DEVICE AND RELATED OUTPUT ENABLE SIGNAL TRANSFORMATION DEVICE IN AN LCD DEVICE

BACKGROUND OF THE INVENTION

1. Field of the Invention

The present invention relates to a driving device and related output enable signal transformation device in a liquid crystal display (LCD) device, and more particularly, to a driving device and related output enable signal transformation device for enhancing the brightness of the LCD device.

2. Description of the Prior Art

The advantages of a liquid crystal display (LCD) include lighter weight, less electrical consumption, and less radiation contamination. LCD monitors have been widely applied to various portable information products, such as notebooks, mobile phones, PDAs (Personal Digital Assistants), etc. In an LCD monitor, incident light produces different polarization or refraction effects when the alignment of liquid crystal molecules is altered. The transmission of the incident light is affected by the liquid crystal molecules, and thus magnitude of the light emitted from the liquid crystal molecules varies. The LCD monitor utilizes the characteristics of the liquid crystal molecules to control the corresponding light transmittance and produces gorgeous images according to different magnitudes of red, blue, and green light.

Please refer to FIG. 1. FIG. 1 is a block diagram of an LCD device 10 according to the prior art. The LCD device 10 includes a panel 100, a timing generator 102, a data-line-signal output circuit 104 and a scan-line-signal output circuit 106. The data-line-signal output circuit 104 includes source drivers 140 in series. The scan-line-signal output circuit 106 includes gate drivers 160 in series. FIG. 1 illustrates 3 gate drivers 160 named G0, G1 and G2 as an example, but is not limited to this number.

The operation of the LCD device 10 is described as follows. The timing generator 102 generates a data signal DATA, a horizontal synchronization signal STH and a horizontal clock signal CLK and related control signals and outputs these signals to the data-line-signal output circuit 104. On the other hand, the timing generator 102 generates a vertical synchronization signal STV, a vertical clock signal CPV and an output enable signal OE and outputs these signals to the scan-line-signal output circuit 106. The source drivers 140 in series in the data-line-signal output circuit 104 sequentially transmit the horizontal synchronization signal STH and the gate drivers 160 in series in the scan-line-signal output circuit 106 sequentially transmit the vertical synchronization signal STV. As shown in FIG. 1, the data signal DATA is transformed to the voltage signals via the data-line-signal output circuit 104 and the scan-line-signal output circuit 106 for controlling the voltage difference on the equivalent capacitor of each pixel on the panel 100 for displaying, and the data signal DATA is displayed in the following sequence: $p_n(x,y)$, $p_n(x+1,y)$, $p_n(x+2,y)$ . . . $p_n(x,y+1)$, $p_n(x+1,y+1)$, $p_n(x+2,y+1)$ . . . and so on. In addition, the output enable signal OE is utilized for performing logic operations for generating the channel output signals of the gate drivers 160, so as to adjust the efficiency of the LCD device 10. Note that, only one channel is allowed to output in a gate driver 160 at the same time.

Please refer to FIG. 2, which illustrates a block diagram of a gate driver 160 in the LCD device 10. The gate driver 160 comprises a first level shifter 200, a shift register module 202, a logic circuit 204, a second level shifter 206, a buffer 208, and a third level shifter 210. The first level shifter 200 is coupled to the timing generator 102 and is utilized for level-shifting the vertical synchronization signal STV, the vertical clock signal CPV and the output enable signal OE and outputs these signals to the shift register module 202. The shift register module 202 is coupled to the first level shifter 200 and is utilized for outputting a plurality of scan signals XO to the logic circuit 204. As shown in FIG. 2, the gate driver 160 includes k channels so that the plurality of scan signals XO are named XO(0)-XO(k−1). The logic circuit 204 is coupled to the shift register module 202 and is utilized for performing logic operations on the scan signals XO(0)-XO(k−1) and output enable signal OE for generating channel output signals. The second level shifter 206 is utilized for level-shifting the channel output signals, and the buffer 208 is utilized for buffering and outputting the channel output signals. In addition, the third level shifter 210 is utilized for level-shifting the vertical synchronization signal STV and outputting the vertical synchronization signal STV to a next gate driver 160.

Please refer to FIG. 3, which illustrates a timing diagram of a frame period of a channel output signal in the LCD device 10. As shown in FIG. 3, the LCD device 10 includes total of m channels controlled by 3 gate drivers 160, G0, G1 and G2. The shift register module 202 outputs the scan signals XO sequentially. Note that, only one channel of a gate driver 160 is allowed to output (XO is in a HIGH state) and at the same time, other channels of the same gate driver 160 are not allowed to output (XO is in a LOW state.) In addition, please refer to FIG. 4, which illustrates a timing diagram of the output enable signal OE in the LCD device 10. OE0, OE1 and OE2 respectively represent the output enable signals corresponding to the gate drivers G0, G1 and G2. The void section shown in FIG. 4 represents a data valid period of the output enable signal OE corresponding to a frame. $T_{V_TOTAL}$ represents a frame period, $T_{V_ACTIVE}$ represents a data valid period and $T_{V_BLANK}$ represents a blanking period. As shown in FIG. 4, because the LCD device 10 has only an output enable signal OE, the timing of OE0, OE1 and OE2 are the same. From the above, the LCD device 10 cannot drive any two channels that are not adjacent.

Generally, a motion blur frequently occurs when the LCD device displays motion pictures. In the prior art, different kinds of impulse driving methods are used to improve the blur problem. For example, a time-division driving method for a gate driver which saves a lot of frame buffers and is easily operated with the black insertion, can improve the blur problem and enhance the brightness of the LCD device. The time-division driving method means that the LCD device has to be able to drive any two channels that are not adjacent. However, the time-division driving method cannot be implemented in the LCD device 10 which has only one output enable signal OE and cannot drive any two channels that are not adjacent.

Please refer to FIG. 5. FIG. 5 is a block diagram of an LCD device 50 according to the prior art. FIG. 5 illustrates 3 gate drivers 560 named G0, G1 and G2 as an example. The LCD device 50 is similar to the LCD device 10 and the difference is that the gate drivers G0, G1 and G2 in the LCD device 50 are respectively controlled by different output enable signals OE0, OE2 and OE2. Compared with the LCD device 10, each gate driver 560 is controlled by a dedicated output enable signal that is different from each other, so that the time-division driving method can be implemented in the LCD device 50.

Please refer to FIG. 6. FIG. 6 is a timing diagram of a vertical synchronization signal STV and three different output enable signals OE0, OE2 and OE2 in the LCD device 50. Note that, one (or more) additional impulse signal STV2, which is used for inserting a black frame between two normal frames, is inserted between two sequential vertical synchronization signals STV. In addition, the void section OED shown in FIG. 6 represents a data valid period of the output enable signal OE0/OE1/OE2 corresponding to a normal frame, and the dotted section OEB shown in FIG. 6 represents a period of the output enable signal OE0/OE1/OE2 corresponding to a black frame. $T_{V_TOTAL}$ represents a frame period and $T_{K_LINE}$ represents a period for k scan lines. From the above, the vertical synchronization signal STV is located at the coverage of OED and the impulse signal STV2 is located at the coverage of OEB. As mentioned previously, only one channel of a gate driver is allowed to output and other channels of the same gate driver are not allowed to output, so that there is an available region for the impulse signal STV2. For example, if a gate driver 560 in the LCD device 50 includes k channels, the impulse signal STV2 cannot be located in the period for k scan lines, $T_{K_LINE}$. As a result, the impulse signal STV2 available region is limited by a boundary shown as the dash line in FIG. 6. The available region limits the flexibility of the impulse signal STV2. That is, the flexibility of black insertion is limited.

As shown in FIG. 6, in the LCD device 50, the smallest ratio of impulse signal available region to a frame period is $T_{K_LINE}/T_{V_TOTAL}$ and the largest ratio of impulse signal available region to a frame period is $(T_{V_TOTAL}-T_{K_LINE})/T_{V_TOTAL}$. When the integration of the gate driver 560 is getting higher, the gate driver 560 can control more channels so that the number of gate drivers in the LCD device 50 is reduced and the number of output enable signals is reduced, so that the flexibility of time-division driving method is limited. Correspondingly, the flexibility of black insertion is limited and the brightness of the LCD device 50 is decreased.

In a word, in the prior art time-division driving method, a plurality of output enable signals are used to control gate drivers for enhancing the flexibility of black insertion for improving the blur problem when displaying motion pictures. On the other hand, with the advancement of semiconductor manufacture, the number of gate drivers required in the LCD device is reduced and correspondingly, the number of output enable signals is reduced and the impulse signal available region is limited. As a result, the flexibility of time-division driving method is limited and the brightness of the LCD device is decreased.

SUMMARY OF THE INVENTION

It is therefore a primary objective of the claimed invention to provide an output enable signal transformation device in a gate driver of an LCD device for enhancing the brightness of the LCD device.

The present invention discloses an output enable signal transformation device for a gate driver in an LCD device, which comprises a reception terminal, a shift register module, a multiplexer module and an output terminal. The reception terminal is coupled to a timing generator of the LCD device and is utilized for receiving an enable synchronization signal, an enable clock signal and a plurality of enable control signals generated by the timing generator. The shift register module is coupled to the reception terminal and is utilized for shifting the enable synchronization signal according to the enable clock signal. The multiplexer module is coupled to the shift register module and the timing generator and is utilized for generating a plurality of output enable signals according to the enable synchronization signal and the plurality of enable control signals. The output terminal is coupled to the multiplexer module and a logic circuit of the gate driver and is utilized for outputting the plurality of output enable signals to the logic circuit.

The present invention further discloses a driving device for an LCD device for enhancing the brightness of the LCD device, which comprises a panel, a timing generator, a plurality of source drivers and a plurality of gate drivers. The timing generator is utilized for generating a vertical synchronization signal, a vertical clock signal, an enable synchronization signal, an enable clock signal and a plurality of enable control signals. The plurality of source drivers are coupled to the timing generator and the panel and are utilized for outputting image data to the panel. The plurality of gate drivers are coupled to the timing generator and the panel and are utilized for driving the panel to display image data, wherein each gate driver comprises a first shift register module coupled to the timing generator for performing operations on the vertical synchronization signal and the vertical clock signal for outputting a plurality of scan signals, a logic circuit coupled to the first shift register module for performing logic operations on the plurality of scan signals and a plurality of output enable signals for outputting a plurality of channel output signals, and an output enable signal transformation device coupled between the timing generator and the logic circuit for generating the plurality of output enable signals according to the enable synchronization signal, the enable clock signal and the plurality of enable control signals.

These and other objectives of the present invention will no doubt become obvious to those of ordinary skill in the art after reading the following detailed description of the preferred embodiment that is illustrated in the various figures and drawings.

DETAILED DESCRIPTION

By using the idea of shift register, the present invention generates a plurality of output enable signals and divides the plurality of output enable signals into many groups for controlling channel output signals of a gate driver in an LCD device.

Figure 1:
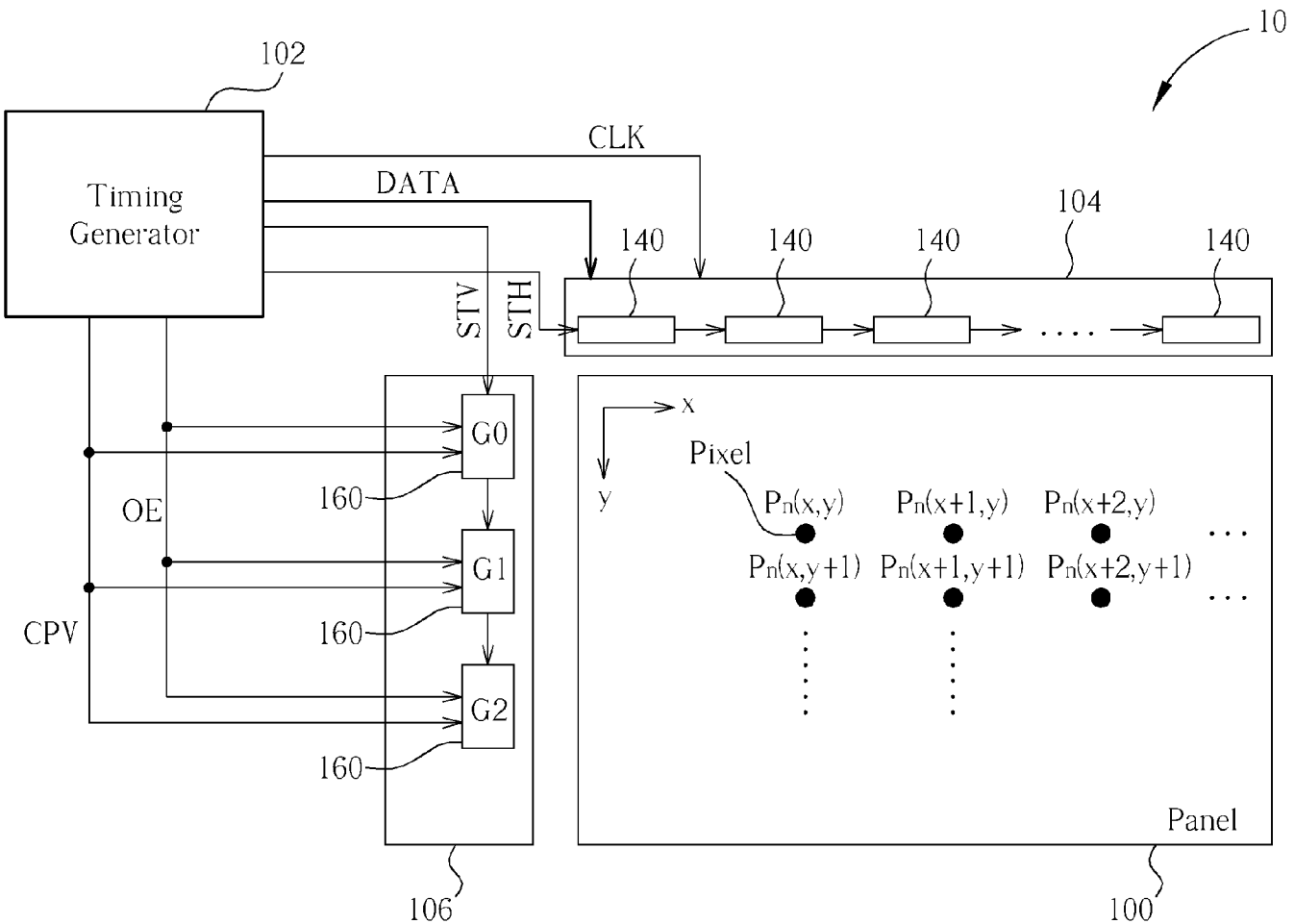
FIG. 1 PRIOR ART
FIG. 1 is a block diagram of an LCD device according to the prior art.
Figure 2:
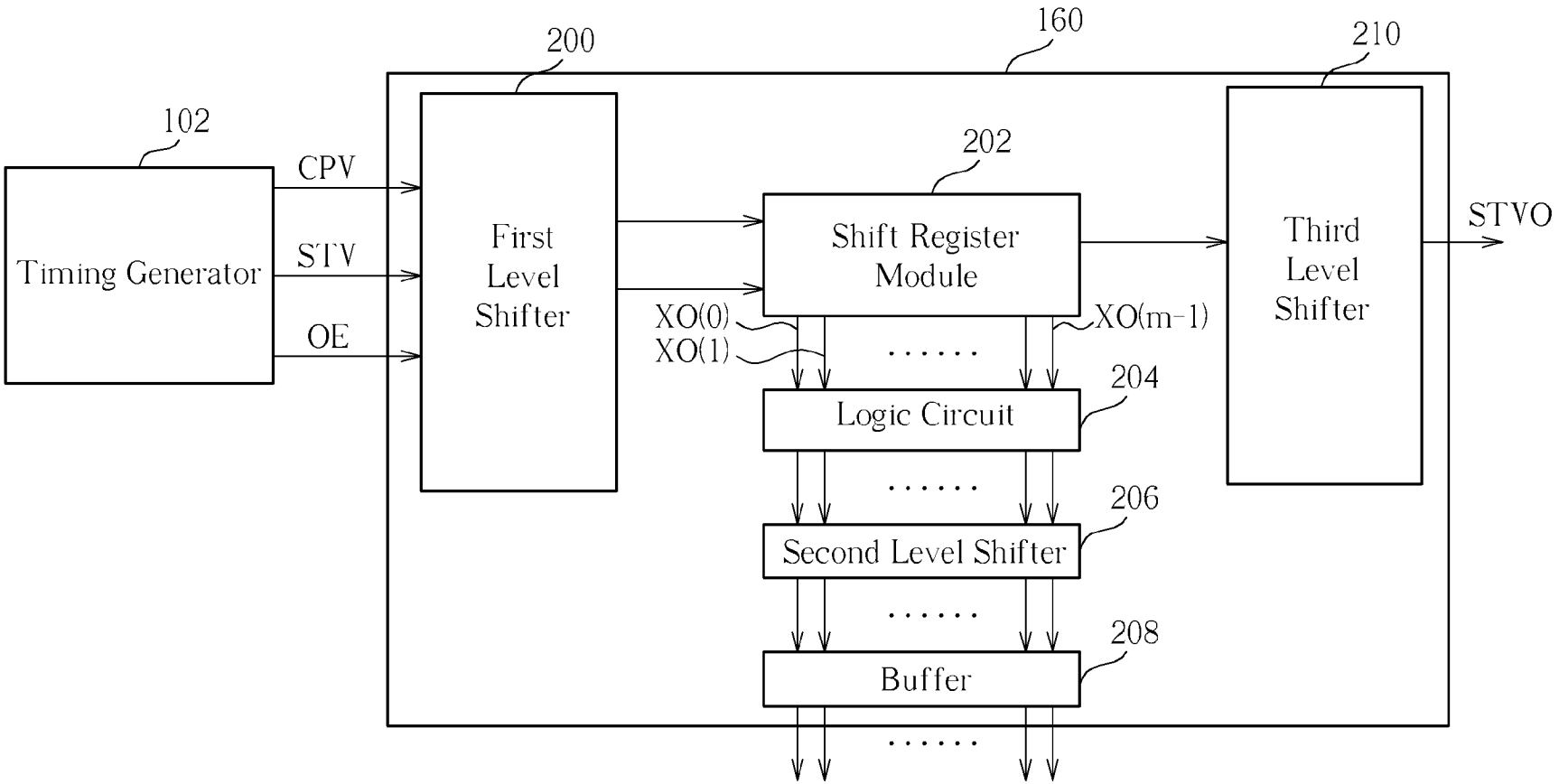
FIG. 2 PRIOR ART
FIG. 2 is a block diagram of a gate driver in the LCD device shown in FIG. 1.
Figure 3:
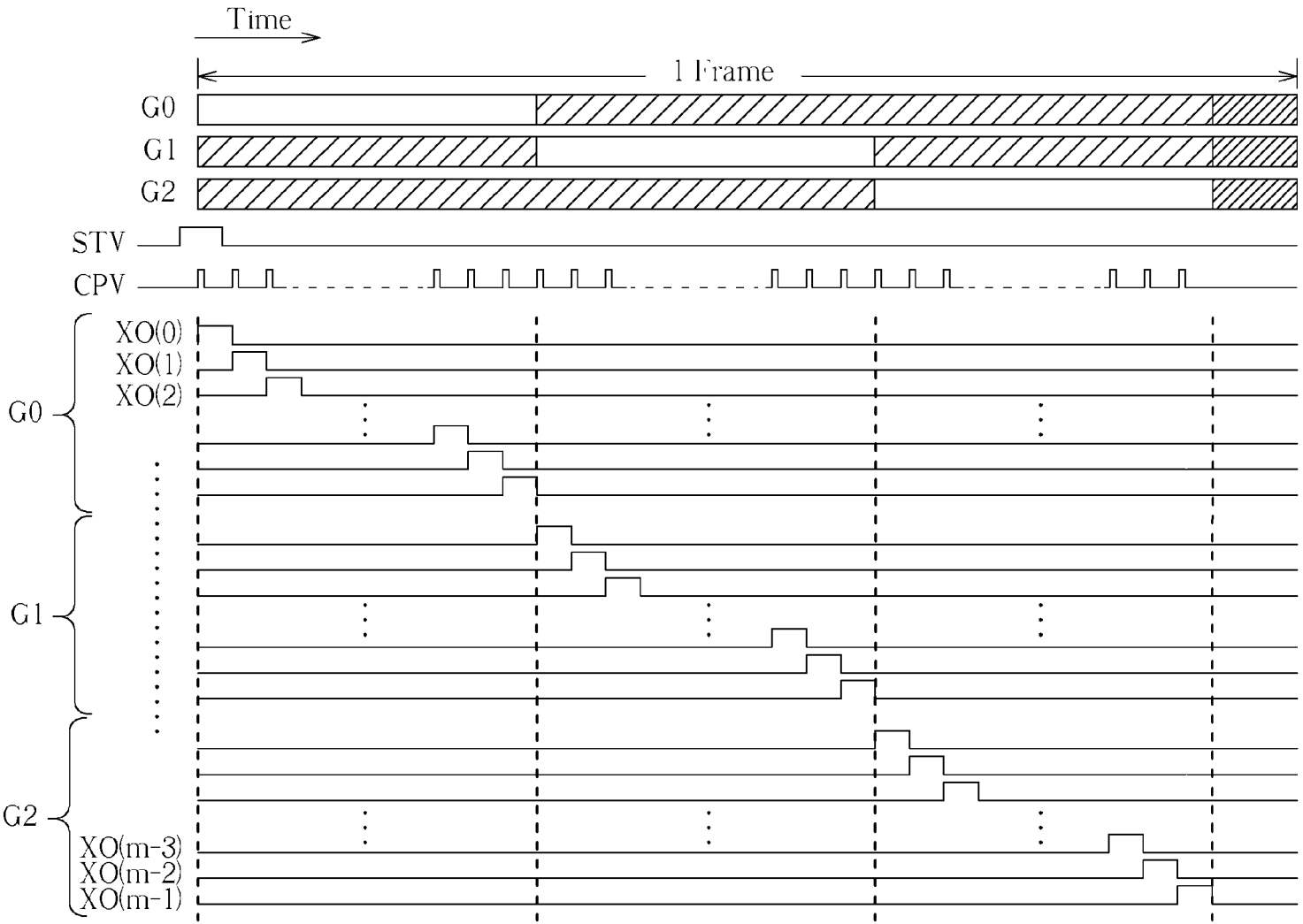
FIG. 3 PRIOR ART
FIG. 3 is a timing diagram of a frame period of a channel output signal in the LCD device shown in FIG. 1.
Figure 4:
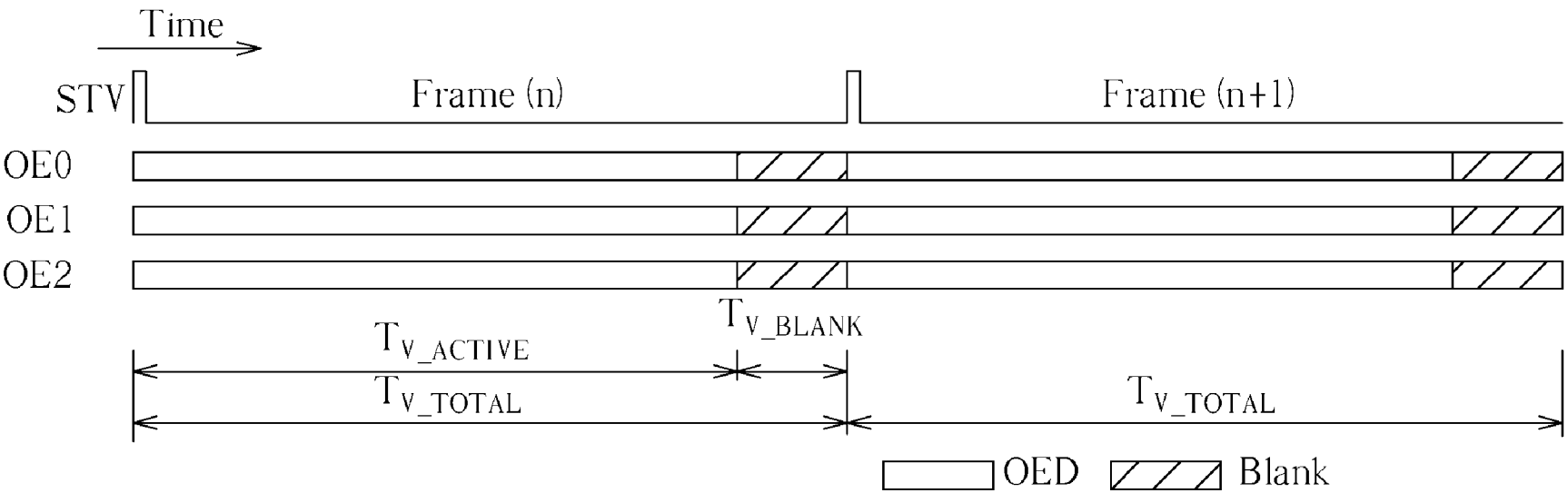
FIG. 4 PRIOR ART
FIG. 4 is a timing diagram of an output enable signal in the LCD device shown in FIG. 1.
Figure 5:
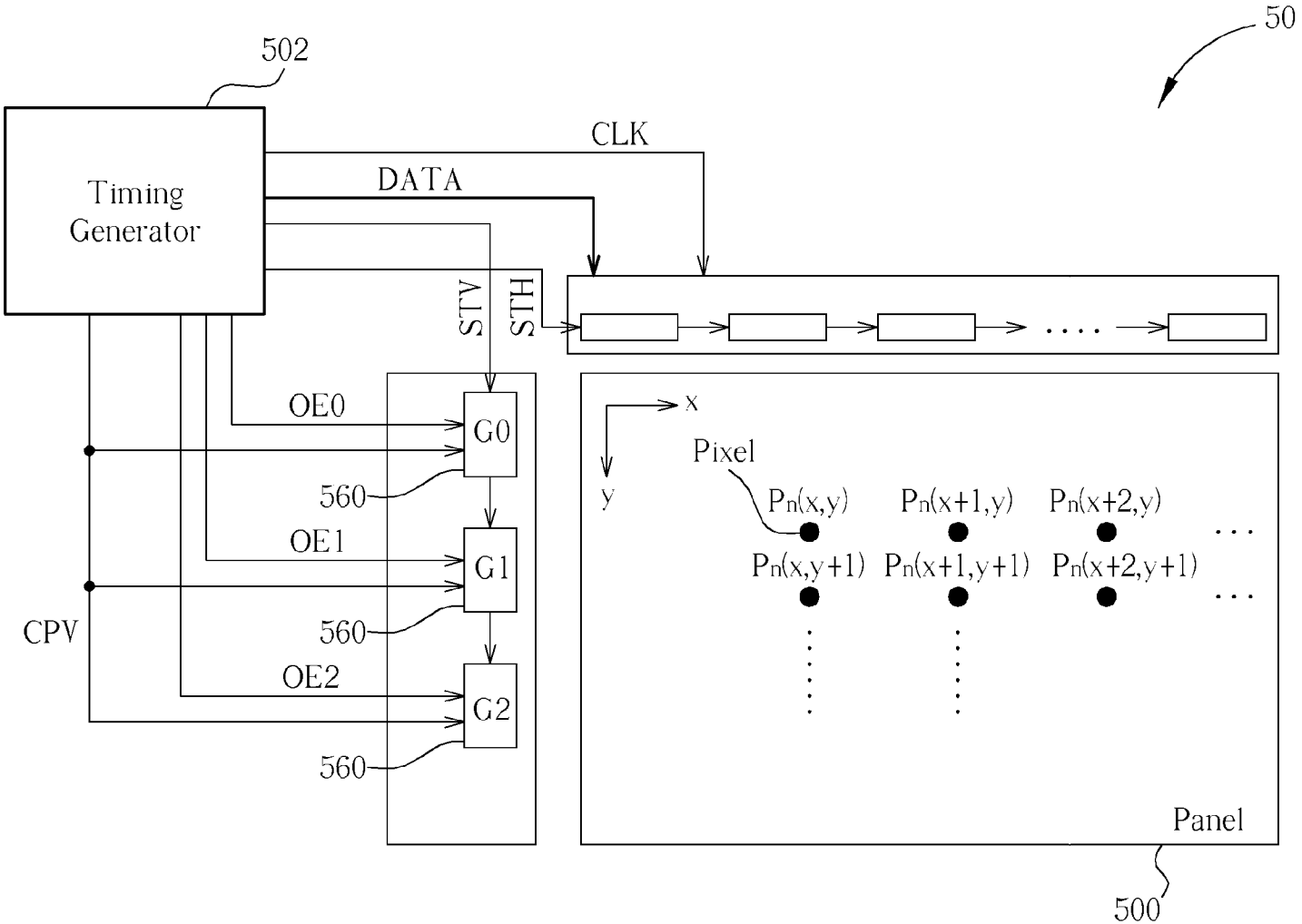
FIG. 5 PRIOR ART
FIG. 5 is a block diagram of an LCD device according to the prior art.
Figure 6:
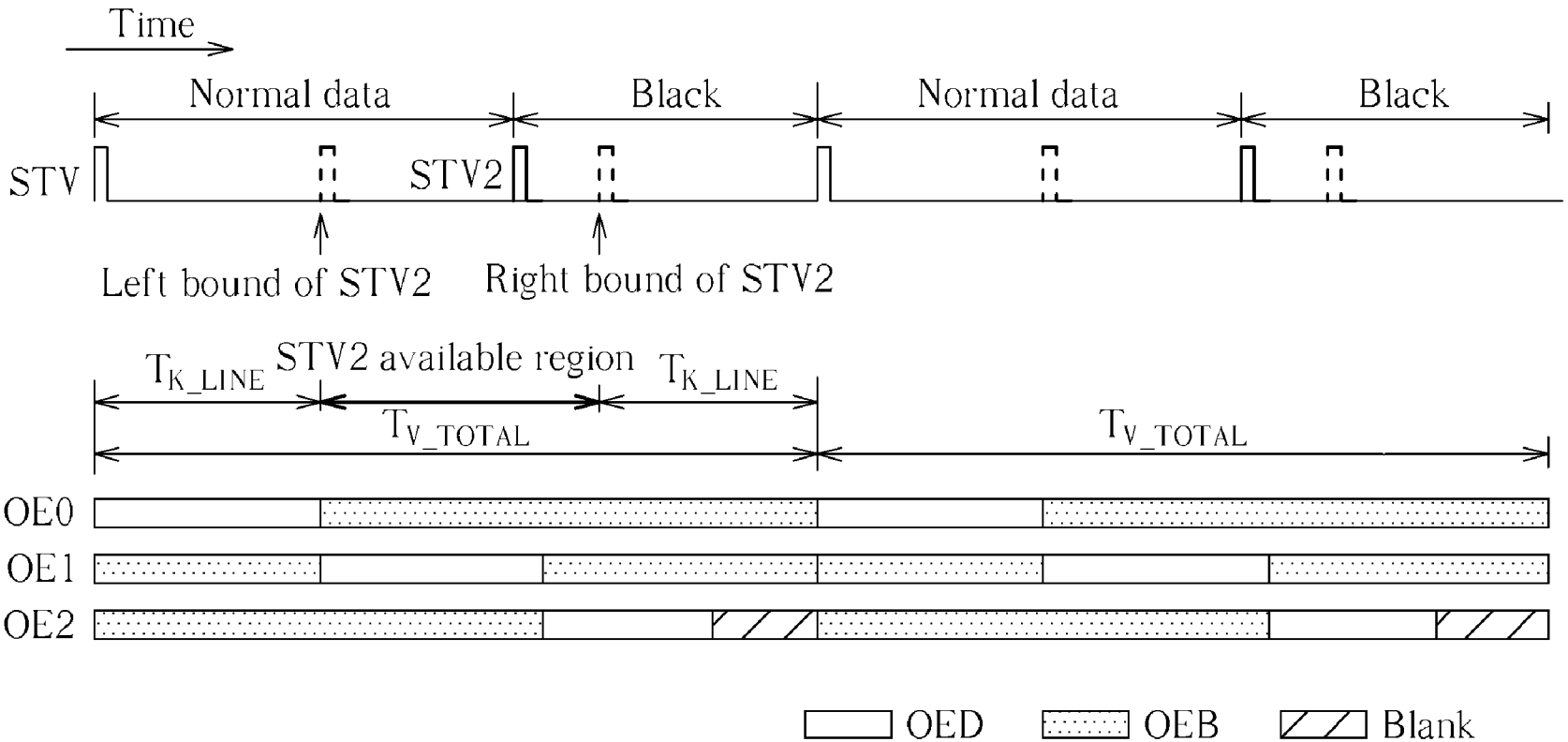
FIG. 6 PRIOR ART
FIG. 6 is a timing diagram of a vertical synchronization signal and 3 output enable signals of the LCD device shown in FIG. 5.
Figure 7:
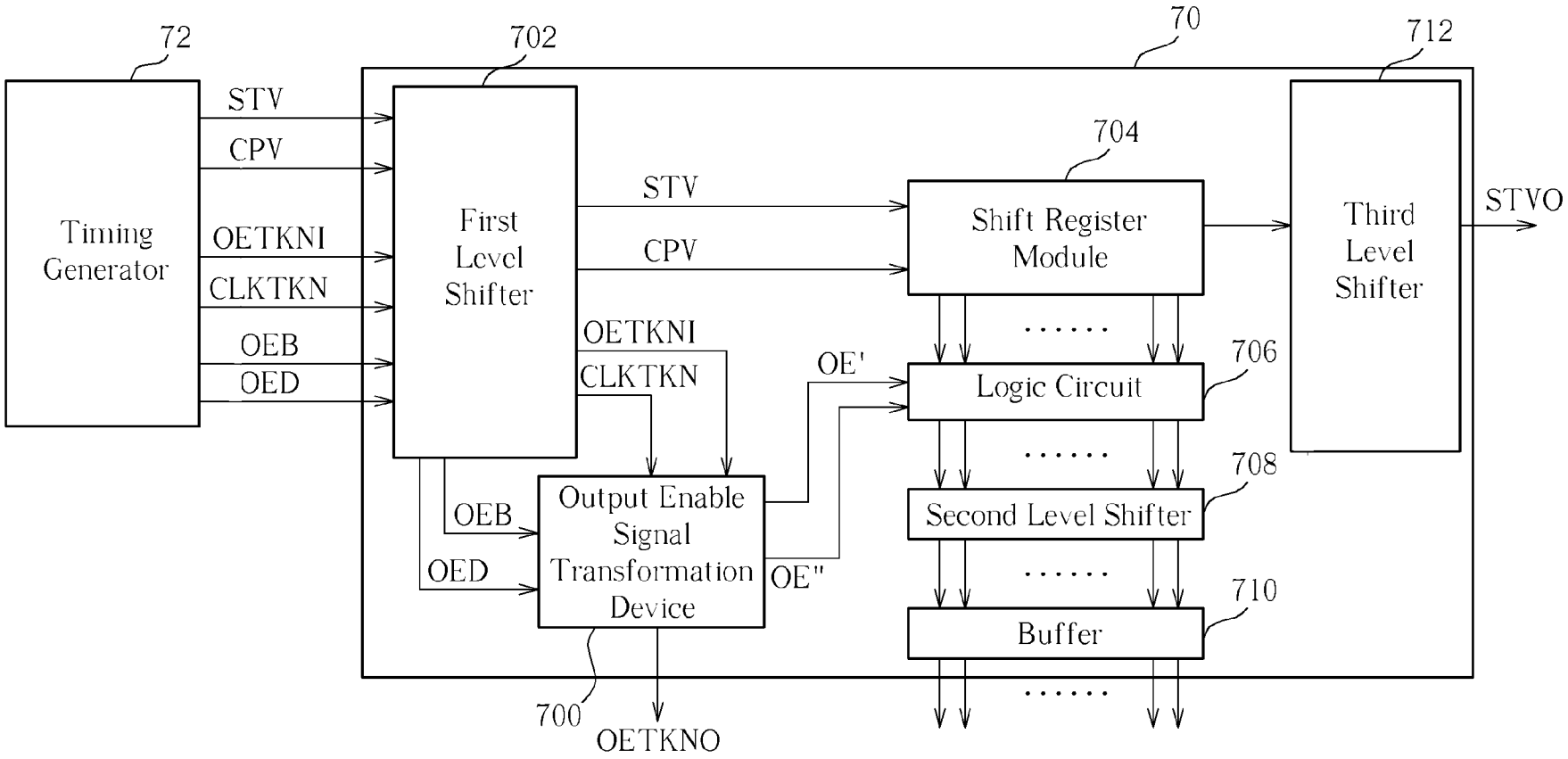
FIG. 7 is a block diagram of a gate driver according to an embodiment of the present invention.

Please refer to FIG. 7, which illustrates a block diagram of a gate driver 70 according to an embodiment of the present invention. The gate driver 70 comprises a first level shifter 702, a shift register module 704, a logic circuit 706, a second level shifter 708, a buffer 710, a third level shifter 712 and an output enable signal transformation device 700. The first level shifter 702 is coupled to a timing generator 72 and is utilized for level-shifting a vertical synchronization signal STV, a vertical clock signal CPV, an enable synchronization signal OETKNI, an enable clock signal CLKTKN, and enable control signals OED and OEB generated by the timing generator 72. The shift register module 704 is coupled to the first level shifter 702 and is utilized for performing operations on the vertical synchronization signal STV and the vertical clock signal CPV and outputting a plurality of scan signals. The logic circuit 706 is coupled to the shift register module 704 and is utilized for performing logic operations on the plurality of scan signals and two output enable signals OE' and OE" for generating a plurality of channel output signals. The second level shifter 708 is coupled to the logic circuit 706 and is utilized for level-shifting the plurality of channel output signals. The buffer 710 is coupled to the second level shifter 708 and is utilized for buffering and outputting the plurality of channel output signals. The third level shifter 712 is coupled to the shift register module 704 and is utilized for level-shifting the vertical synchronization signal STV for generating a vertical synchronization signal STVO and outputting the vertical synchronization signal STVO to a next gate driver. Particularly, the output enable signal transformation device 700 is coupled to the first level shifter 702 and the logic circuit 706 and is utilized for generating the output enable signals OE' and OE" according to the enable synchronization signal OETKNI, the enable clock signal CLKTKN and the enable control signals OED and OEB.

Figure 8:
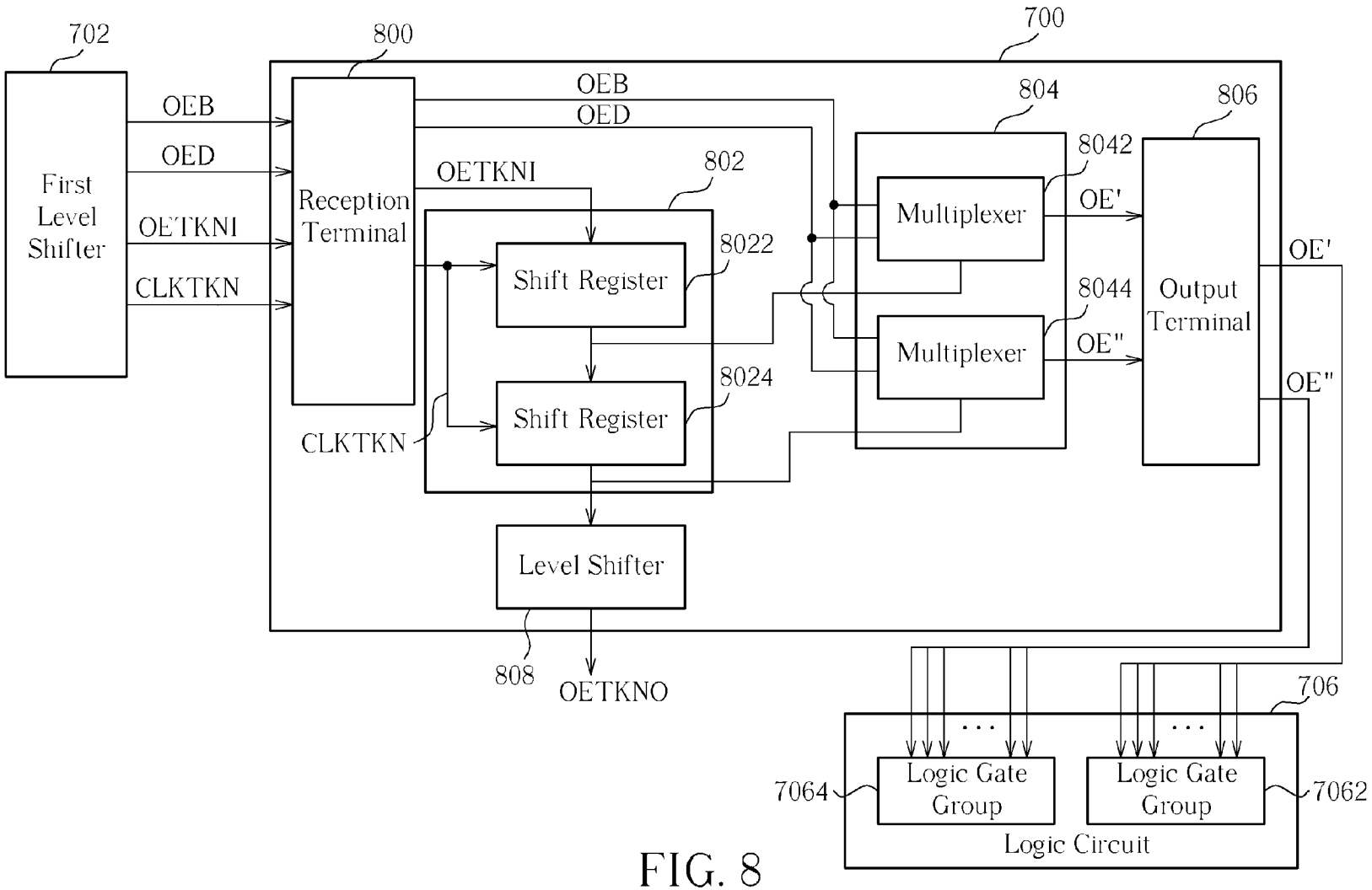
FIG. 8 is a block diagram of an output enable signal transformation device of the gate driver shown in FIG. 7.

The operations of the logic circuit 706 and the output enable signal transformation device 700 are described in detail as follows. Please refer to FIG. 8, which illustrates a block diagram of the output enable signal transformation device 700 shown in FIG. 7. The output enable signal transformation device 700 comprises a reception terminal 800, a shift register module 802, a multiplexer module 804, an output terminal 806 and a level shifter 808. The reception terminal 800 is coupled to the first level shifter 702 and is utilized for receiving the enable synchronization signal OETKNI, the enable clock signal CLKTKN and the enable control signals OED and OEB. Note that, the enable control signals OED and OEB are different. The enable control signal OED is used to control a data valid period for a gate driver during a frame period, and the enable control signal OEB is used to control a black period for a gate driver during a frame period. The shift register module 802 is coupled to the reception terminal 800 and is utilized for shifting the enable synchronization signal OETKNI according to the enable clock signal CLKTKN. In detail, the shift register module 802 comprises shift registers 8022 and 8024 in series. The shift register 8022 transmits the enable synchronization signal OETKNI to the shift register 8024 according to the enable clock signal CLKTKN. The multiplexer module 804 is coupled to the shift register module 802 and the reception terminal 800 and is utilized for generating the output enable signals OE' and OE" according to the enable synchronization signal OETKNI and the enable control signals OED and OEB. In detail, the multiplexer module 804 comprises multiplexers 8042 and 8044 and is utilized for selecting one from the enable control signals OED and OEB according to output signals of the shift registers 8022 and 8024 for generating the output enable signals OE' and OE". The output terminal 806 is coupled to the multiplexer module 804 and the logic circuit 706 and is utilized for outputting the output enable signals OE' and OE" to the logic circuit 706. The level shifter 808 is coupled to the shift register module 802 and is utilized for level-shifting the enable synchronization signal OETKNI and outputting an enable synchronization signal OETKNO to another output enable signal transformation device in the next gate driver adjacent to the gate driver 70.

On the other hand, the logic circuit 706 comprises logic gate groups 7062 and 7064 which are respectively corresponding to the output enable signals OE' and OE". The logic circuit 706 is utilized for performing logic operations on the plurality of scan signals and the output enable signals OE' and OE" for generating a plurality of channel output signals. For example, if the gate driver 70 includes k channels, that is, the logic circuit 706 comprises k logic gates, the logic circuit 706 is divided into two logic gate groups 7062 and 7064 according to the output enable signals OE' and OE", and performs logic operations correspondingly.

From the above, the output enable signal transformation device 700 generates the output enable signals OE' and OE" via the shift register module 802 and the multiplexer module 804. Next, all logic gates of the logic circuit 706 are divided into two logic gate groups 7062 and 7064 according to the output enable signals OE' and OE", and perform logic operations correspondingly for outputting the plurality of channel output signals. In the prior art, the application of time-division driving method is limited by the integration of the gate driver. In comparison, the present invention can increase the number of shift registers in the shift register module 802 and the number of multiplexers in the multiplexer module 804 on demand. In a word, the output enable signal transformation device 700 is independent of the integration of the gate driver so that the output enable signal transformation device 700 can generate a required number of output enable signals, so as to enhance the flexibility of black insertion for improving the brightness of the LCD device.

Figure 9:
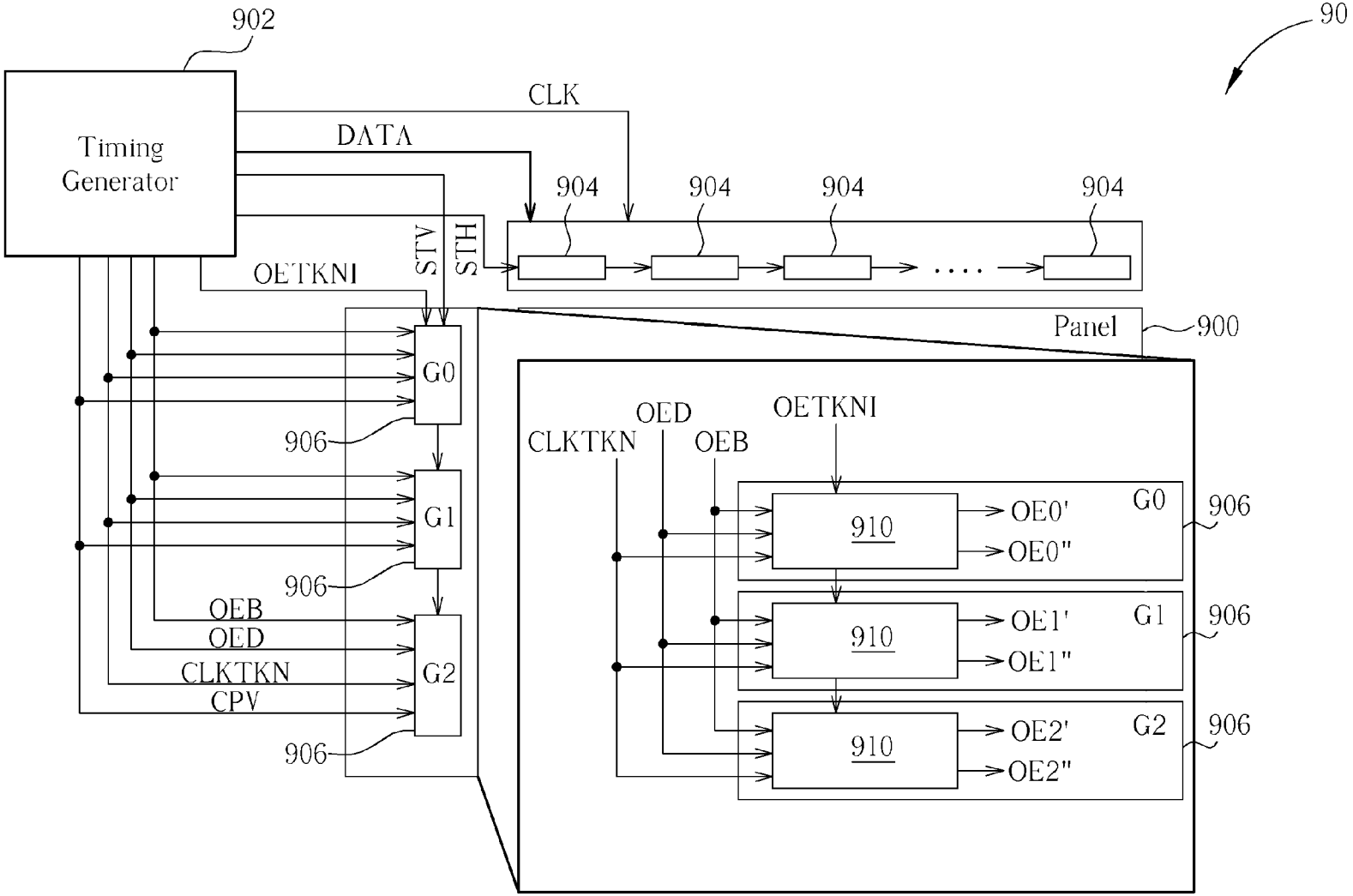
FIG. 9 is a block diagram of a driving device for an LCD device according to an embodiment of the present invention.

Please refer to FIG. 9. FIG. 9 is a block diagram of a driving device 90 for an LCD device according to an embodiment of the present invention. The driving device 90 comprises a panel 900, a timing generator 902, a plurality of source drivers 904 and a plurality of gate drivers 906. FIG. 9 illustrates 3 gate drivers 906 named G0, G1 and G2 as an example, but is not limited to this number. The timing generator 902 is utilized for generating a data signal DATA, a horizontal synchronization signal STH and a horizontal clock signal CLK, a vertical synchronization signal STV, a vertical clock signal CPV, an enable synchronization signal OETKNI, an enable clock signal CLKTKN, and enable control signals OED and OEB. Note that, the enable control signals OED and OEB are different. The enable control signal OED is used to control a data valid period for a gate driver during a frame period, and the enable control signal OEB is used to control a black period for a gate driver during a frame period. The plurality of source drivers 904 are in series and are coupled between the panel 900 and the timing generator 902 for outputting image data to the panel 900. The plurality of gate drivers 906, G0, G1 and G2, are in series and are coupled between the panel 900 and the timing generator 902 for driving the panel 900 to display image data.

Note that, each gate driver 906 in the driving device 90 is similar to the gate driver 70 as above. That is, each output enable signal transformation device 910 in the gate driver 906 is similar to the output enable signal transformation device 700 as above. In the driving device 90, each output enable signal transformation device 910 in the gate driver 906 generates 2 output enable signals that divide the logic circuit in the gate driver 906 into 2 logic gate groups. Therefore, total 3 logic circuits in 3 gate drivers 906 are divided into 6 logic gate groups via the output enable signal transformation devices 910. Note that, the output enable signal transformation device 910 is only an embodiment of the present invention, and those skilled in the art can make alterations and modifications accordingly. For example, if the shift register module includes 3 shift registers and the multiplexer module includes 3 multiplexers in the output enable signal transformation devices 910, the output enable signal transformation devices 910 generates 3 output enable signal so that total 3 logic circuits are divided into 9 logic gate groups via the output enable signal transformation devices 910.

Figure 10:
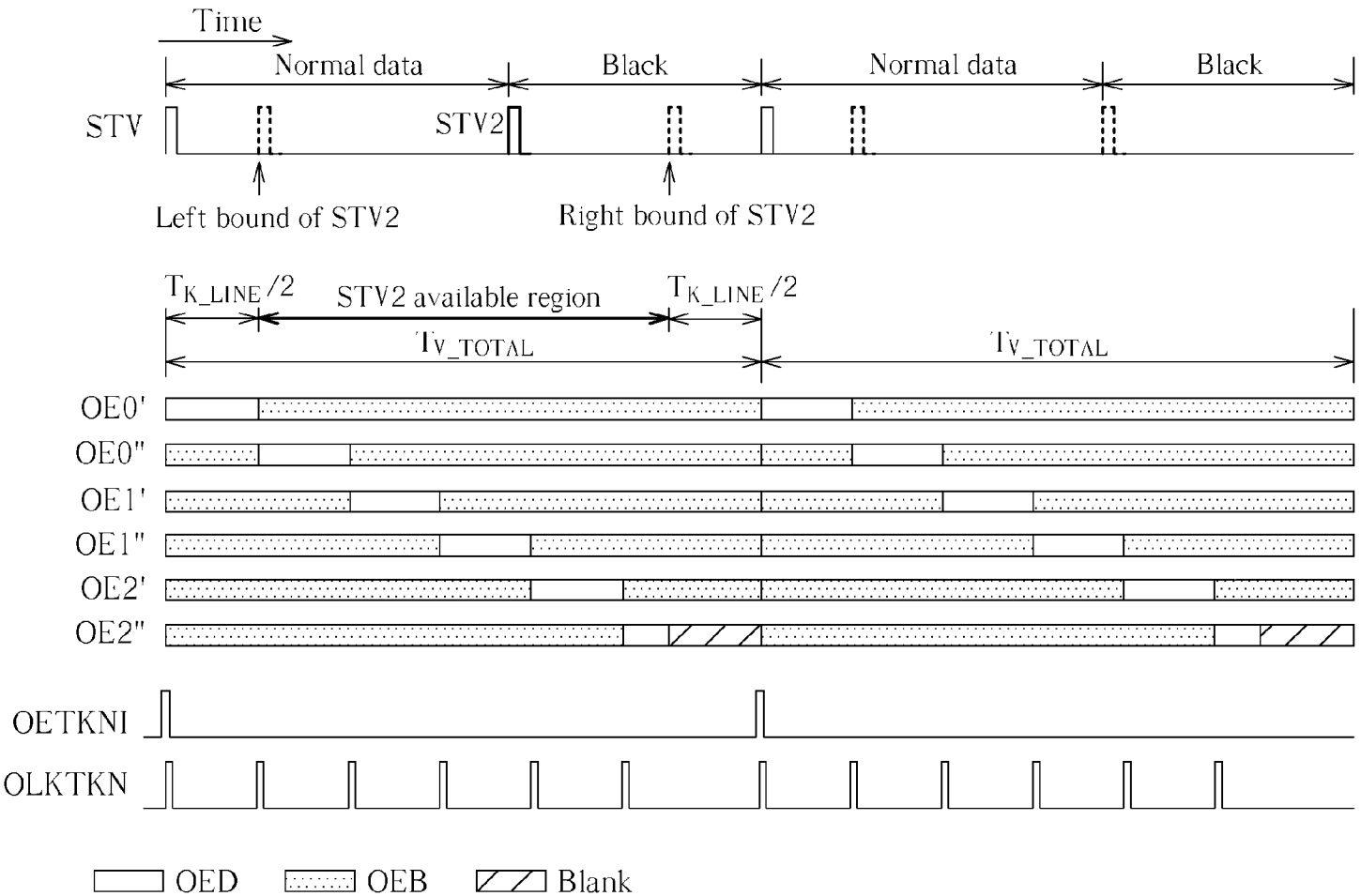
FIG. 10 is a timing diagram of a vertical synchronization signal and 6 output enable signals of the driving device shown in FIG. 9.

Please refer to FIG. 10. FIG. 10 is a timing diagram of the vertical synchronization signal STV and 6 output enable signals of the driving device 90 shown in FIG. 9. The 6 output enable signals are OE0', OE0", OE1', OE1", OE2' and OE2" that divides all logic circuits in the driving device 90 into 6 logic gate groups. In FIG. 10, one (or more) additional impulse signal STV2, which is used for inserting a black frame between two normal frames, is inserted between two sequential vertical synchronization signals STV. The black insertion is utilized for improving blur problems when the LCD device displays motion pictures. In addition, the void section OED shown in FIG. 10 represents a data valid period for the output enable signal OE0'/OE0"/OE1'/OE1"/OE2'/OE2" corresponding to a normal frame, and the dotted section OEB shown in FIG. 10 represents a period f or the output enable signal OE0'/OE0"/OE1'/OE"/OE2'/OE2" corresponding to a black frame. $T_{V_TOTAL}$ represents a frame period, and $T_{K_LINE}/2$ represents a period for (k/2) scan lines.

From the above, each output enable signal transformation device 910 can generate 2 output enable signals. If a gate driver in the LCD device includes k channels, the k channels are divided into 2 channel groups via the output enable signal transformation device 910 and each channel group is utilized for driving (k/2) scan lines. The period for (k/2) scan lines is $T_{K_LINE}/2$, the smallest ratio of impulse signal available region to a frame period is $(T_{K_LINE}/2)/T_{V_TOTAL}$, and the largest ratio of impulse signal available region to a frame period is $(T_{V_TOTAL}-T_{K_LINE}/2)/T_{V_TOTAL}$. Therefore, the driving device 90 enlarges the impulse signal available region so as to enhance the flexibility of black insertion and the brightness of the LCD device.

In conclusion, the present invention generates a plurality of output enable signals via a shift register module and a multiplexer module in an output enable signal transformation device in a gate driver, so that all logic gates in the gate driver can be divided into many groups and perform logic operations correspondingly. Therefore, the present invention enhances the flexibility of black insertion and the brightness of the LCD device.

Those skilled in the art will readily observe that numerous modifications and alterations of the device and method may be made while retaining the teachings of the invention.

What is claimed is:

1. An output enable signal transformation device for a gate driver in an LCD device comprising:

a reception terminal coupled to a timing generator of the LCD device for receiving an enable synchronization signal, an enable clock signal and a plurality of enable control signals generated by the timing generator;

a shift register module coupled to the reception terminal for shifting the enable synchronization signal according to the enable clock signal;

a multiplexer module coupled to the shift register module and the timing generator for generating a plurality of output enable signals according to the enable synchronization signal and the plurality of enable control signals; and an output terminal coupled to the multiplexer module and a logic circuit of the gate driver for outputting the plurality of output enable signals to the logic circuit.

2. The output enable signal transformation device of claim 1, wherein the logic circuit of the gate driver comprises a plurality of logic gate groups and each logic gate group corresponds to one of the plurality of output enable signals.

3. The output enable signal transformation device of claim 1, wherein the shift register module comprises a plurality of shift registers in series and each shift register is utilized for shifting the enable synchronization signal to a next shift register according to the enable clock signal.

4. The output enable signal transformation device of claim 1, wherein the multiplexer module comprises a plurality of multiplexers and each multiplexer is utilized for selecting one of the plurality of enable control signals according to the enable synchronization signal for generating one of the plurality of output enable signals.

5. The output enable signal transformation device of claim 1, further comprising a level shifter coupled to the shift register module for level-shifting the enable synchronization signal outputted from the shift register module.

6. A driving device for an LCD device for enhancing the brightness of the LCD device comprising:

a panel;

a timing generator for generating a vertical synchronization signal, a vertical clock signal, an enable synchronization signal, an enable clock signal and a plurality of enable control signals;

a plurality of source drivers coupled to the timing generator and the panel for outputting image data to the panel; and a plurality of gate drivers coupled to the timing generator and the panel for driving the panel to display image data, each gate driver comprising:

a first shift register module coupled to the timing generator for performing operations on the vertical synchronization signal and the vertical clock signal for outputting a plurality of scan signals;

a logic circuit coupled to the first shift register module for performing logic operations on the plurality of scan signals and a plurality of output enable signals for outputting a plurality of channel output signals; and an output enable signal transformation device coupled between the timing generator and the logic circuit for generating the plurality of output enable signals according to the enable synchronization signal, the enable clock signal and the plurality of enable control signals.

7. The driving device of claim 6, wherein the transformation device comprises:

a reception terminal coupled to the timing generator for receiving the enable synchronization signal, the enable clock signal and the plurality of enable control signals;

a second shift register module coupled to the reception terminal for shifting the enable synchronization signal according to the enable clock signal;

a multiplexer module coupled to the reception terminal and the second shift register module for generating the plurality of output enable signals according to the enable synchronization signal and the plurality of enable control signals; and an output terminal coupled to the multiplexer module and the logic circuit for outputting the plurality of output enable signals to the logic circuit.

8. The driving device of claim 7, wherein the second shift register module comprises a plurality of shift registers in series and each shift register is utilized for shifting the enable synchronization signal to a next shift register according to the enable clock signal.

9. The driving device of claim 7, wherein the multiplexer module comprises a plurality of multiplexers and each multiplexer is utilized for selecting one of the plurality of enable control signals according to the enable synchronization signal for generating one of the plurality of output enable signals.

10. The driving device of claim 7, further comprising a level shifter coupled to the second shift register module for level-shifting the enable synchronization signal outputted from the second shift register module and then outputting the enable synchronization signal to a next output enable signal transformation device of a next gate driver.

11. The driving device of claim 6, wherein the logic circuit of the gate driver comprises a plurality of logic gate groups and each logic gate group corresponds to one of the output enable signals.

12. The driving device of claim 6, wherein each of the plurality of gate drivers further comprises a level shifter coupled to the logic circuit for level-shifting the plurality of scan signals and outputting the plurality of scan signals to the panel.

13. The driving device of claim 12, wherein each of the plurality of gate drivers further comprises a buffer coupled between the level shifter and the panel for buffering the plurality of scan signals.

14. The driving device of claim 6, wherein each of the plurality of gate drivers further comprises a level shifter coupled to the timing generator, the first shifter register module and the output enable signal transformation device for level-shifting signals outputted from the timing generator.

15. The driving device of claim 6, wherein each of the plurality of gate drivers further comprises a level shifter coupled to the first shifter register module for level-shifting the vertical synchronization signal and then outputting the vertical synchronization signal to a next gate driver.

* * * * *